US006792221B1

(12) United States Patent
Katoh

(10) Patent No.: US 6,792,221 B1
(45) Date of Patent: Sep. 14, 2004

(54) IMAGE FORMING APPARATUS AND METHOD FOR REVISING IMAGE DENSITY

(75) Inventor: Tetsuo Katoh, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/388,184

(22) Filed: Mar. 14, 2003

(51) Int. Cl.[7] ..... G03G 15/02
(52) U.S. Cl. ..... 399/50; 399/43; 399/55
(58) Field of Search ..... 399/38, 43, 45, 399/50, 53, 55, 56, 258, 259, 272

(56) References Cited

U.S. PATENT DOCUMENTS 6,134,395 A * 10/2000 Sasaki et al. ..... 399/46
6,134,396 A * 10/2000 Kaneko ..... 399/55

FOREIGN PATENT DOCUMENTS

JP 2001-42613 A 2/2001

OTHER PUBLICATIONS

U.S. patent application Ser. No. 10/164,714, Katoh, filed Jun. 10, 2002.

* cited by examiner

*Primary Examiner*—Hoang Ngo
(74) *Attorney, Agent, or Firm*—Foley & Lardner LLP

(57) ABSTRACT

In an image forming apparatus employing a two-component developing system, there are provided print-sheet number counting means; developing-device drive time integrating means for integrating time during which a developing device drives; and a toner replenishing motor drive time integrated drive time integrating means for integrating time during which a toner replenishing motor drives. Integrated drive time of the developing device and integrated drive time of the motor toner replenishing motor every fixed printed-sheet number, and the toner consuming quantity per drive time of the developing device is calculated from the extracted data. The toner charge quantity in a developer is predicted on the basis of the calculated data, and a developing bias voltage applied to the developing device is changed to thereby revised an image density.

8 Claims, 6 Drawing Sheets

IMAGE FORMING APPARATUS AND METHOD FOR REVISING IMAGE DENSITY

BACKGROUND OF THE INVENTION

1. Field of the Invention

The present invention relates to an image forming apparatus employing an electrophotographic system such as a laser printer, an electrophotographic copying machine and so on, particularly to an image forming apparatus employing a two-component developing system, and a method for revising an image density in the image forming apparatus.

2. Related Art Statement

In an image forming apparatus employing an electrophotographic system which employs a two-component developing system, a developer comprising a carrier in the form of magnetic powder and a toner in the form of colored resin powder is inserted into a developing device, the carrier and the toner are mixed and stirred by a stirrer disposed within the developing device, and the toner is charged by friction Further, where the toner is consumed by development, a toner is replenished into the developing device from a toner hopper, the replenished toner is mixed with the carrier and stirred, and charging is done by friction, similarly to that mentioned above.

The consuming quantity of toner per drive time of the developing device varies according to the printing rate or the number of prints per print operation.

Where the printing rate is low, it is natural that even if the drive time of the developing device is the same, the quantity of toner consumed is small, and therefore, the consuming quantity of toner per drive time of the developing device is reduced.

On the other hand, the reason why the consuming quantity varies according to the print number per printing operation is as follows: Before the start and after the printing operation, there is time during which the developing device is driven without developing. So, suppose that 999 sheets are printed, in case of intermittently printing every three-sheet, the time during which the developing device is driven without developing is accumulated and longer than that of the case of printing continuously. That is, where the printing number per printing operation is small, the consuming quantity of toner per drive time of the developing device is reduced.

Incidentally, there appears a phenomenon that in the two-component developing system, where the developing device is driven continuously in the state that toner is not consumed, the charge quantity of toner becomes changed due to the excessive friction. Such a phenomenon as described results from the properties of toner, but in a toner material whose charge quantity increases where the developing device is driven continuously, there poses a problem in that where the printing rate is low or where the printing number per printing operation is small, the consuming quantity of toner per drive time of the developing device is small so that the charge quantity of toner increases more than a proper value, because of which the image density lowers.

Conversely, in a toner material whose charge quantity decreases where the developing device is driven continuously, there poses a problem in that where the printing rate is low or where the printing number per printing operation is small, the consuming quantity of toner per drive time of the developing device is small so that the charge quantity of toner decreases more than a proper value, because of which the image density rises.

In any case, where the printing rate and the printing number per printing operation, that is, the consuming quantity of toner per drive time of the developing device is not taken into consideration, there occurs an inconvenience that the image density lowers or rises, resulting in absence of stability in printing state.

In view of the foregoing, as a method for overcoming such a problem as noted above to revise the image density, there has been proposed heretofore a method for calculating the printing rate on the basis of a pixel counter to thereby obtain information relating to the toner consuming quantity. However, the pixel counter is a device for integrating emitting time of a semiconductor laser to thereby obtain information, and therefore, an area of an electrostatic latent image formed on a photosensitive drum can be grasped, but the actual toner quantity adhered to the electrostatic latent image cannot be grasped. Since the adhered toner quantity depends on the oner charge quantity in the developer, information relating to the toner consuming quantity obtained is often uneven, and even if the printing condition is changed on the basis of that information, after all the image density could not be maintained in the stabilized state.

Further, as the other method for revising image density, there has been proposed a method for irradiating light on a batch-like toner image formed on a photosensitive drum, disposing a sensor for measuring reflecting light thereof, calculating the toner adhered quantity from the measured value, thereby changing the printing conditions. However, its sensor is so expensive that the whole apparatus becomes high in cost. Further, since the batch-like toner image has to be formed on the photosensitive drum, it is necessary to stop normal printing operation every time the image is formed, so that more toner is consumed, and the photosensitive drum is driven excessively, resulting in shortening the service life of the photosensitive drum.

SUMMARY OF THE INVENTION

An aspect of the present invention has been accomplished in view of problems as noted above with respect to prior art in an image forming apparatus employing a two-component developing system, and has its object to provide an image forming apparatus in which even in a case of using a toner material whose charge quantity is changed where a developing device is driven continuously in the state that toner is not consumed, an image density can be always maintained in a stabilized manner, and a method for revising an image density.

A further object of an aspect of the invention is to provide an image forming apparatus and a method for revising an image density in which an image density can be always maintained in a stabilized manner without increasing costs of the whole apparatus, without excessively driving a photosensitive drum and a developing device, and without excessively consuming tone.

For achieving the aforementioned object, a method for revising an image density according to an aspect of the present invention comprises extracting Integrated driving time of a developing device and integrated driving time of a toner replenishing motor every fixed printing number, calculating toner consuming quantities per drive time of the developing device from said extracted data, predicting a toner charge quantity in a developer on the basis of said calculated data, changing a developing bias voltage applied to the developing device, and thereby revising the image density.

Further, the image forming apparatus according to an aspect of the present invention comprises printed-sheet number counting means, developing-device drive-time integrating means for integrating time during which the developing device is driven, and toner-replenishing motor drive-time integrating means for integrating time during which a toner-replenishing motor is driven, whereby said method for revising an image density is carried out.

DETAILED DESCRIPTION OF THE INVENTION

The form for carrying out the image forming apparatus and the method for revising an image density according to an embodiment of the present invention will be explained in detail hereinafter with reference to the accompanying drawings.

Experiments were carried out, in the two-component developing system, to confirm how the charge quantity of toner is changed due to the difference between the printing rate and the printed-sheet number per printing operation, using a toner material in which the charge quantity increases where the developing device is driven continuously, and how the image density is changed thereby.

The printing rate is set to 2%, 4%, 6%, 8% and 20%, the printed sheet number per printing operation with respect to each printing rate is set to 1, 2, 50, and 999 sheets, and printing of 49950 sheets under each printing condition was carried out. The result is as shown in FIG. 1, and confirmation was made such that where the printing rate is low or where the printed sheet number per printing operation is small, as described above, the charge quantity of toner increases more than a proper value, and the image density lowers.

With respect to each setting condition of the printed sheet number per printing operation, the total drive time of the developing device after printing of 49950 sheets was calculated. The total driving time of the developing device also includes time for driving the developing device without developing before start and after the printing operation. And, a value obtained by multiplying each printing rate by total printed sheet number is divided by total drive time of the developing device, and the printing rate per drive time of the developing device was calculated with respect to each setting condition.

Figure 1:
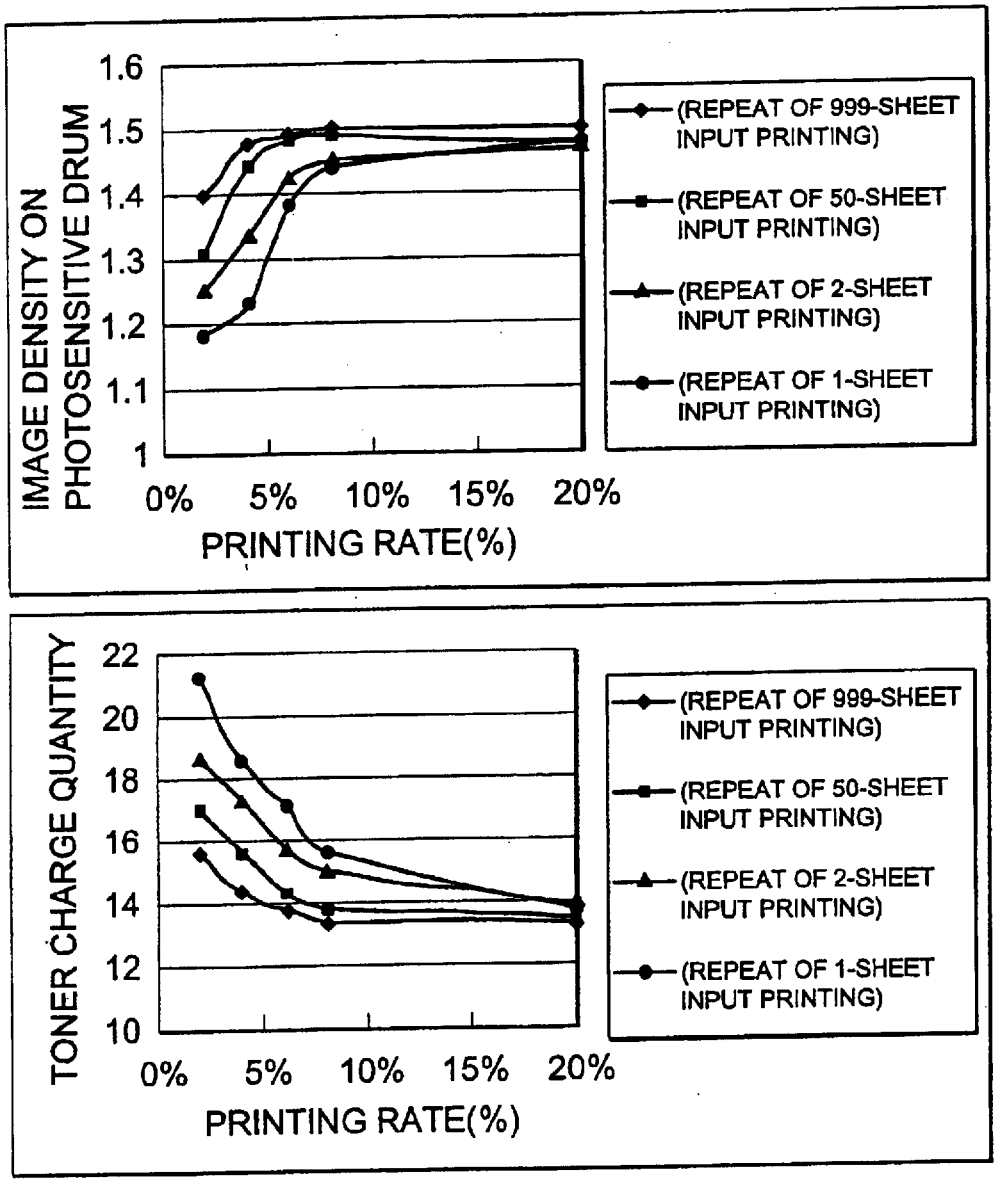
FIG. 1 is a graph showing a relationship between a toner charge quantity in a developer and an image density formed on a photosensitive drum with respect to a printing rate and the printed-sheet number per printing operation.
Figure 2:
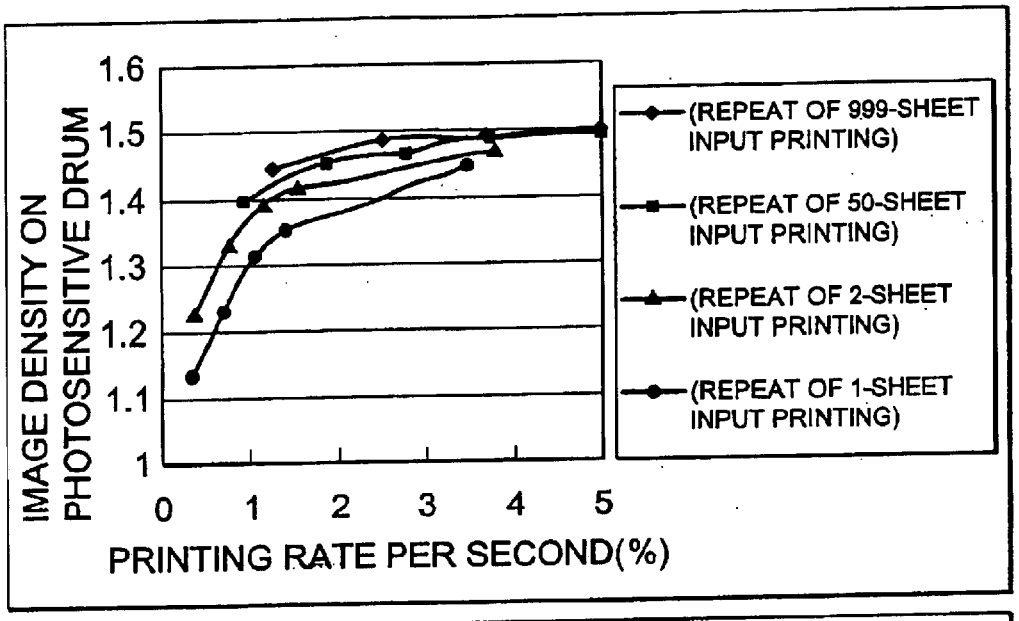
FIG. 2 is a graph showing a relationship between a toner charge quantity in a developer and an image density formed on a photosensitive drum with respect to a printing rate per drive time of a developing device and the printed-sheet number per printing operation.
Figure 2:
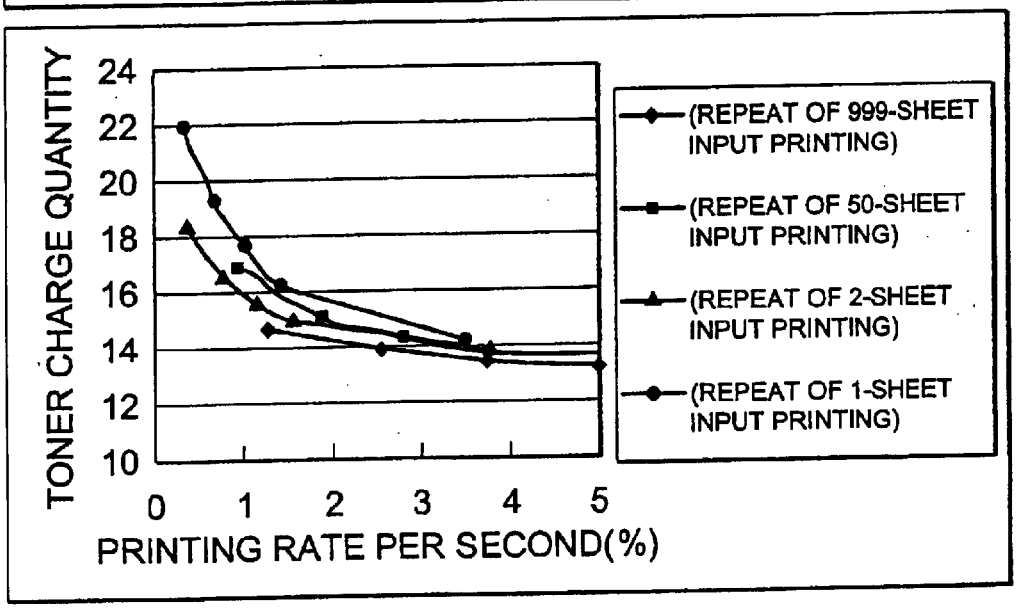

Data where the axis of abscissae is replaced with the printing rate per drive time of the developing device on the basis of data shown in FIG. 1 is as shown in FIG. 2. It is understood from FIGS. 1 and 2 that data which are dispersed with respect to each setting condition in FIG. 1 are converged to some extent in FIG. 2. It is understood therefrom that the phenomenon in which the charge quantity of toner increases and the image density lowers occurs where stirring is continued without consuming toner within the developing device.

The toner consuming quantity of the developing device after printing of 49950 sheets with respect to each printing condition was calculated. And, the toner consuming quantity of the developing device was divided by total drive time of the developing device to calculate the toner consuming quantity per drive time of the developing device with respect to each setting condition.

Figure 3:
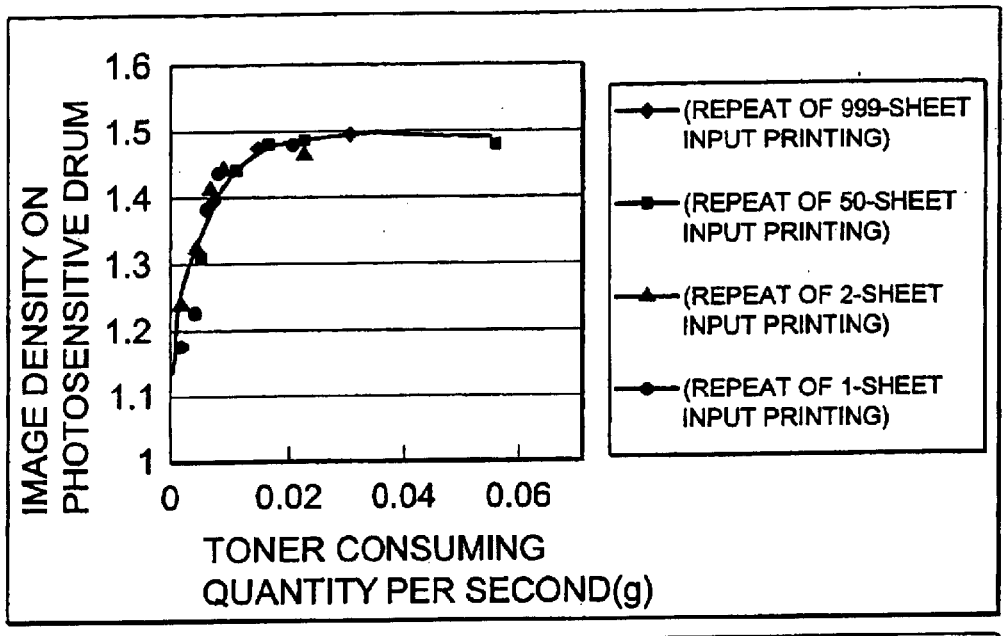
FIG. 3 is a graph showing a relationship between a toner charge quantity in a developer and an image density formed on a photosensitive drum with respect to a printing rate per drive time of a developing device and the printed-sheet number per printing operation.
Figure 3:
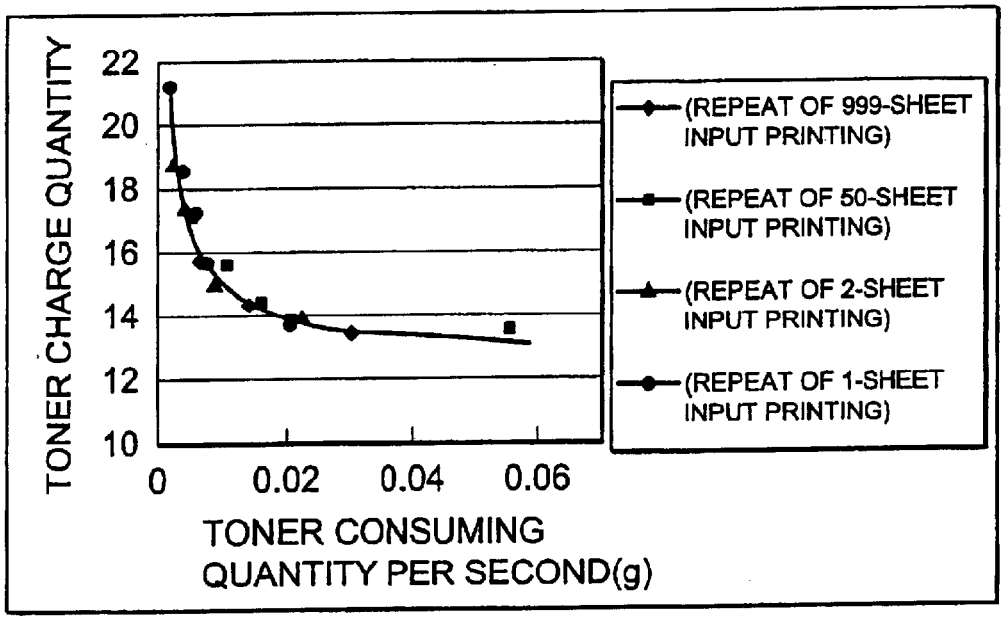

Data where the axis of abscissae is replaced with the toner consuming quantity per drive time of the developing device on the basis of data shown in FIG. 1 is as shown in FIG. 3. It is understood from FIGS. 2 and 3 that data which are converged to some extent with respect to each setting condition in FIG. 2 are converged on approximately the same line in FIG. 3. It is understood therefrom that the phenomenon in which the charge quantity of toner is changed, due to the difference between the printing rate and the printed sheet number per printing operation, and after all, the image density is changed accordingly can be grasped sufficiently in connection with the toner consuming quantity per drive time of the developing device.

It was understood from the aforementioned results of study that it is necessary for always maintaining the image density in the stabilized manner to correctly grasp the toner consuming quantity per drive time of the developing device.

In the developing device employing the two-component developing system, normally, a magnetic type toner-concentration sensor is mounted on the developing device, and where the lowering of the tone concentration in a developer is detected by the magnetic type toner-concentration sensor, a toner replenishing motor is driven by a detection signal thereof so as to replenish toner into the developing device from a toner hopper. Therefore, the toner replenishing quantity can be grasped by integrating drive time of the toner replenishing motor. From this fact, in the present embodiment, the toner consuming quantity is grasped by the toner replenishing quantity, and integrated drive time of the toner replenishing motor is measured.

In the present embodiment, for example, the image density is corrected every time 100 sheets are printed, whether the developing device is driven during what seconds while 100 sheets are printed is grasped as ⌈Integrated drive time of a developing device⌋, and similarly, whether the toner replenishing motor is driven during what seconds while 100 sheets are printed is grasped as ⌈Integrated drive time of a toner replenishing motor⌋. And, the following equation is established:

Integrated drive time of a toner replenishing motor÷integrated drive time of a developing device=toner consuming quantity per drive time of developing device Then the toner consuming quantity per drive time of the developing device is grasped.

The toner charge quantity is predicted on the basis of the thus obtained toner consuming quantity per drive time of the developing device and data shown in FIG. 3, and the image density is predicted. On the basis of the predicted result, and with the image density in the setting condition of [Printing rate: 6% and printed sheet numbers per printing operation: 5 sheets] as a reference, a difference between the predicted image concentration and the reference image density is calculated, a developing bias voltage applied to the developing roller of the developing device is changed, and a developing contrast is changed to thereby revise a density of a toner image formed on the photosensitive drum to provide stabilization.

In changing the developing bias voltage, in order to prevent occurrence of a so-called blush, an applied voltage of a charging device for charging the surface of the photosensitive drum is changed so as to change a so-called blush potential.

However, it was understood that even if the concentration of the toner image formed on the photosensitive drum is made to be stabilized, the concentration of the image finally formed on the recording sheet is not always stabilized.

Figure 4:
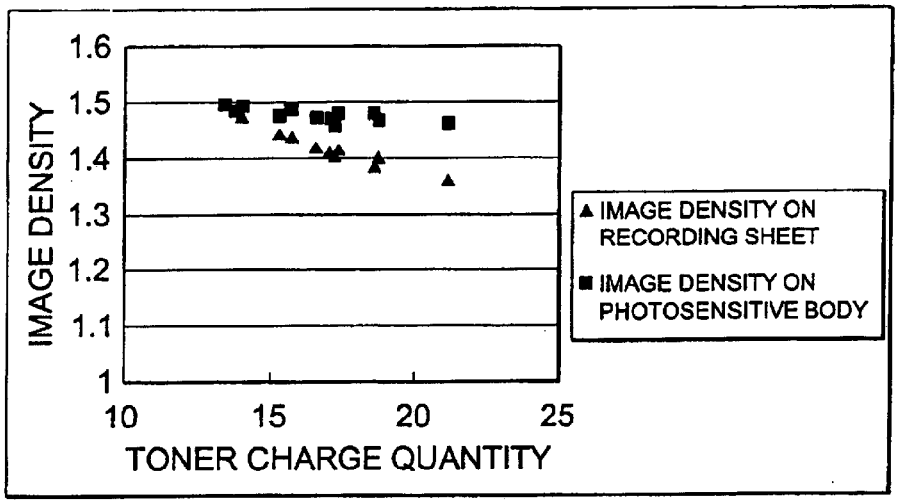
FIG. 4 is a graph showing a relationship between an image density formed on a photosensitive drum and an image density formed on a recording sheet.

In view of the foregoing, the toner charge quantity in the developer was changed to confirm a relationship between the image density formed on the photosensitive drum and the image density formed on the recording sheet. As a result, it is understood that even if the developing contrast is changed to revise the density of the toner image formed on the photosensitive drum for stabilization, as shown in FIG. 4, the transfer efficiency relative to the recording sheet lowers as the charge quantity of tone increases, and therefore, the density of the image formed on the recording sheet is not stabilized as it is.

The charge quantity of the toner increases if the consuming quantity of the toner per drive time of the developing device is small, and therefore, in the present embodiment, the toner charge quantity is predicted, on the basis of the toner consuming quantity per drive time of the developing device, to change the developing bias voltage and also change the transfer bias voltage.

EXAMPLE 1

Figure 5:
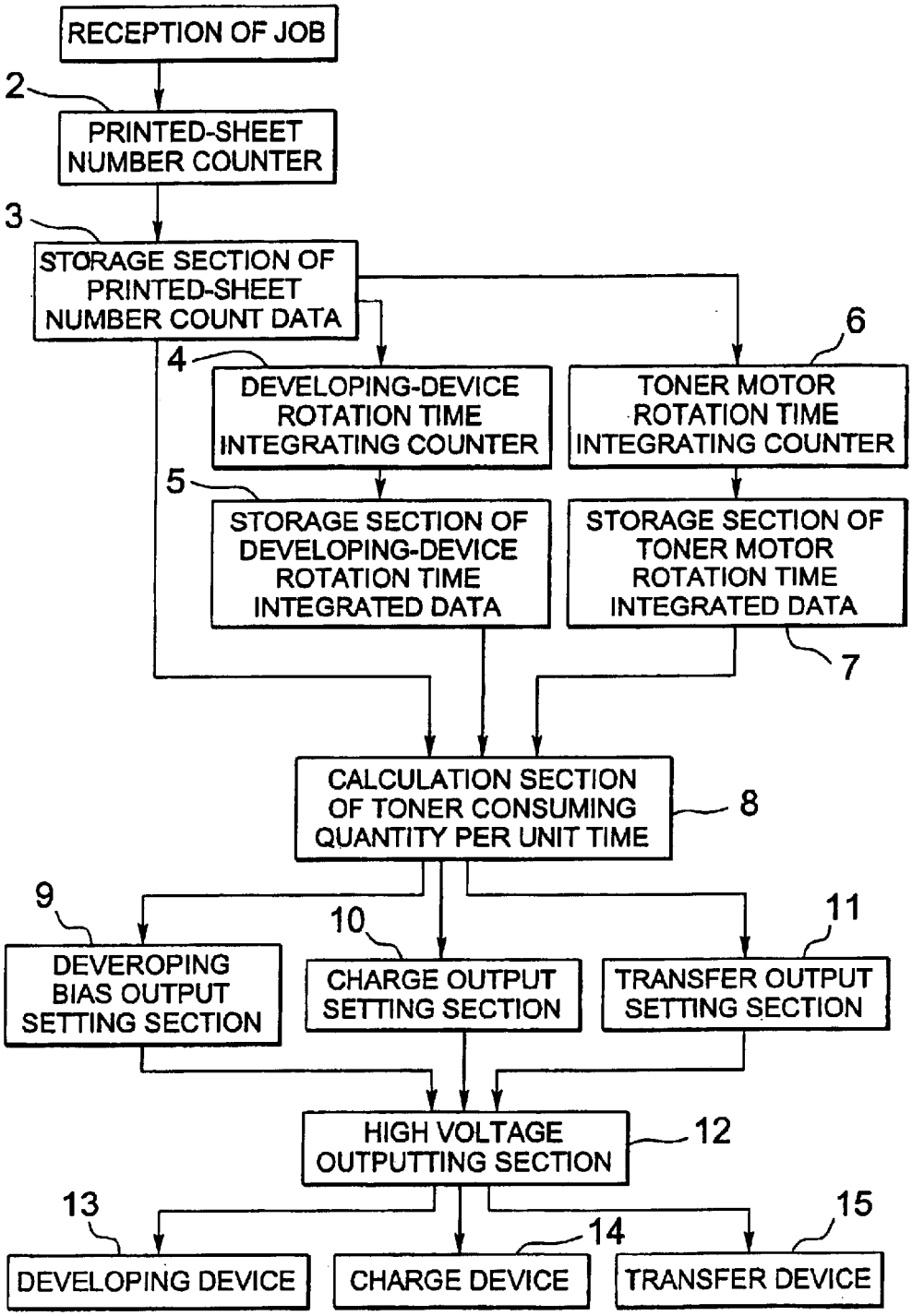
FIG. 5 is a schematic constitutional view of an image density control system in the image forming apparatus according to an embodiment of the present invention.

In order that in the image forming apparatus employing the electrophotographic system and the two-component developing system, the image density is revised, on the basis of the toner consuming quantity per drive time of the developing device, to maintain it in the stabilized manner, there is constituted, in the image forming apparatus according to the present embodiment, an image density control system 1, as shown in FIG. 5, for example.

The image density control system 1 comprises a printed-sheet number counter 2 as printed-sheet number counting means, a printed-sheet number count data storage section (for example, RAM) 3, a developing-device drive time integrating counter 4 as developing-device drive time integrating means, a developing-device drive time integrated data storage section (for example, RAM) 5, a toner replenishing motor drive time integrating counter 6 as toner replenishing motor drive time integrating means, a toner replenishing motor drive time integrated data storage section (for example, RAM) 7, a toner consuming quantity calculation section (for example, ROM and CPU) 8, a developing bias output setting section (for example, ROM and CPU) 9, a charge output setting section (for example, ROM and CPU) 10, a transfer output setting section (for example, ROM and CPU) 11, and a high voltage outputting section (for example, a power supply) 12.

The procedure for revising an image density by the image density control system 1 as described above will be described hereinafter.

When the image forming apparatus starts printing, the printed-sheet number counter 2 counts the printed-sheet number set by a printed-sheet setting button to store printed-sheet number count data in the printed-sheet number count data storage section 3.

On the other hand, the developing-device drive time integrating counter 4 integrates time during which the developing device drives to store developing-device drive time integrated data in the developing-device drive time integrated data storage section 5, and the toner replenishing motor drive time integrating counter 6 integrates time during which a toner replenishing motor drives to store it in the toner replenishing motor drive time integrated data storage section 7.

In the printed-sheet number count data storage section 3, for example, when printed-sheet number data are 500 sheets, printed-sheet number data, developing-device drive time integrated data, and toner replenishing motor drive time integrated data from the printed-sheet number count data storage section 3, the developing-device drive time integrated data storage section 5, and the toner replenishing motor drive time integrated data storage section 7, respectively, are sent to the toner consuming quantity calculation section per developing-device drive time 8.

The toner consuming quantity calculation section per developing-device drive time 8 calculates the toner consuming quantity per drive time of the developing device by the following equation on the basis of these data:

Integrated drive time of a toner replenishing motor÷integrated drive time of a developing device=toner consuming quantity per drive time of developing device The toner charge quantity is predicted on the basis of the thus obtained toner consuming quantity per drive time of the developing device and data shown in FIG. 3, and the image density is predicted.

Figure 6:
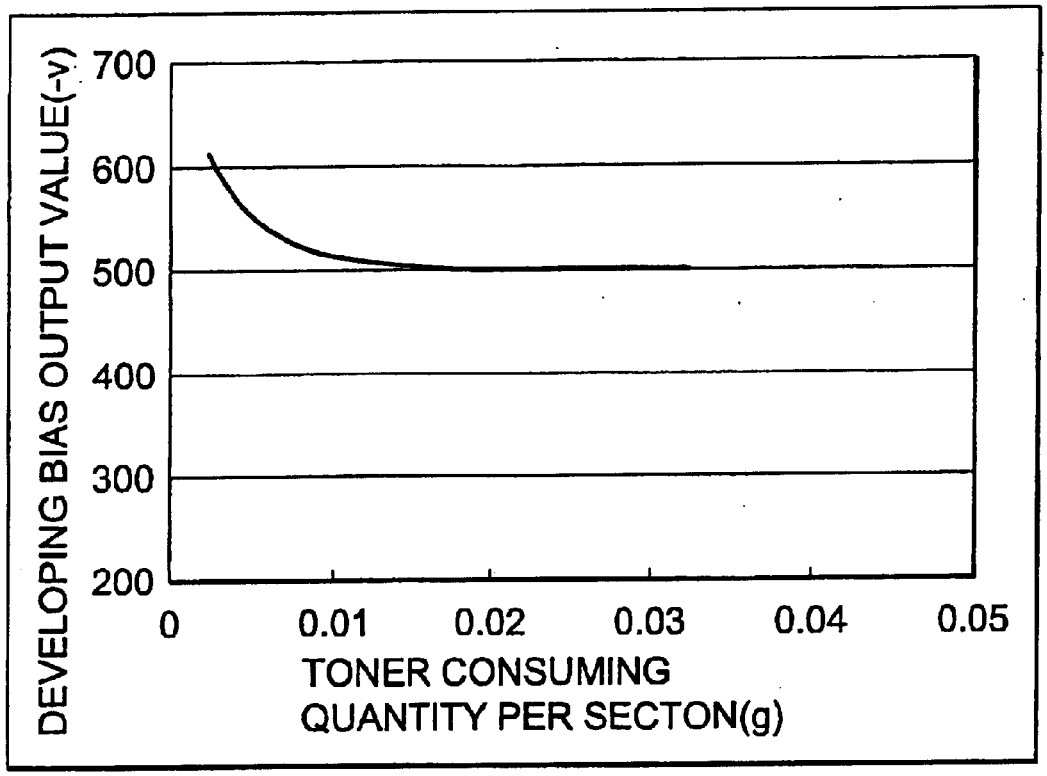
FIG. 6 is a graph showing a relationship between a developing bias voltage value and a transfer output current value with respect to a toner consuming quantity per drive time of a developing device used when the image density is corrected.
Figure 6:
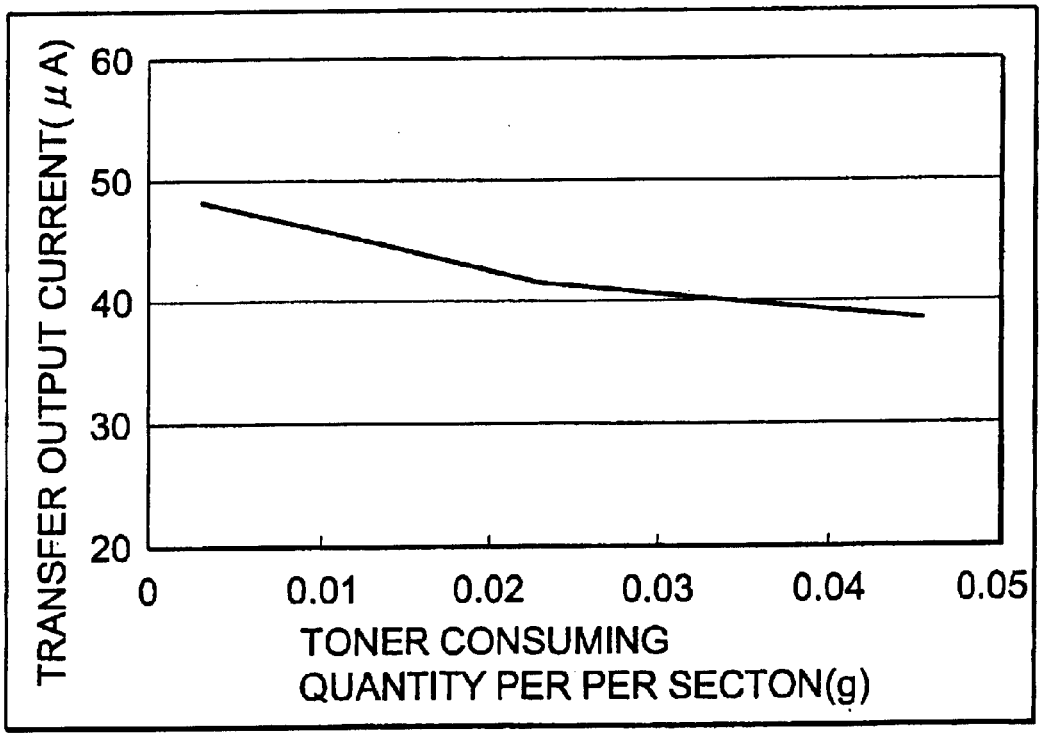

More specifically, the developing bias output setting section 9 sets a developing bias voltage value highly on the bias of the graph shown in FIG. 6, and the transfer output setting section 11 sets a transfer output current value highly on the basis of the graph shown in FIG. 6. The charge output setting section 10 also suitably changes a charge output current value.

The developing bias voltage value, the transfer output current value and the charge output current value which are set by the respective setting sections are sent to the high voltage outputting section 12, and by the high voltage outputting section 12, a corrected developing bias voltage, a corrected transfer output current and a corrected charge output current are applied to a developing device 13, a transfer device 15 and a charge device 14, respectively.

Further, the image forming apparatus continues printing, and when printed-sheet number data are 1000 sheets, 1500 sheets and 2000 sheets, that is, printed-sheet number data, developing-device drive time integrated data and toner replenishing motor drive time integrated data from the printed-sheet number count data storage section 3, the developing-device drive time integrated data storage section 5 and the toner replenishing motor drive time integrated data storage section 7, respectively, are set to the toner consuming quantity calculation section per developing-device drive time 8 every 500 sheets.

And, a revised developing bias voltage, a revised transfer output current and a revised charge output current are applied to the developing device 13, the transfer device 15 and the charge device 14, respectively, by the procedure similar to that described above.

While a description has been made of the case of using a toner material in which where the developing device drives continuously, the charge quantity increases, it is noted that conversely, also in the case of using a toner material in which the charge quantity lowers, the present invention can be applied. However, in that case, a graph different in characteristic from FIG. 6 is to be prepared.

As described above, according to an embodiment of the present invention, in the image forming apparatus employing the two-component developing system, even in the case of using a toner is not material in which where the developing device drives continuously in the state that is not consumed, the charge quantity is changed, the image density can be always maintained in a stabilized manner without increasing cost of the whole apparatus, without excessively driving the photosensitive drum and the developing device, and without excessively consuming toner.

What is claimed is:

1. An image forming apparatus employing a two-component developing system using a developer comprising a carrier and a toner, including: printed-sheet number counting means; developing device drive time integrating means for integrating time during which a developing device drives; and a toner replenishing motor drive time integrating means for integrating time during which a toner replenishing motor drives, wherein integrated drive time of the developing device integrated by the developing-device drive time integrating means and integrated drive time of the toner replenishing motor integrated by the toner replenishing motor drive time integrating means are extracted every fixed printed-sheet number counted by the printed-sheet number counting means, the toner consuming quantity per drive time of the developing device is calculated from the extracted data, the toner charge quantity in a developer is predicted on the basis of the calculated data, and a developing bias voltage applied to the developing device is changed to thereby revise an image density.

2. The image forming apparatus according to claim 1, wherein when the developing bias voltage is changed, an applied voltage of a charge device for charging the surface of a photosensitive body is also changed.

3. The image forming apparatus according to claim 1, wherein the toner consuming quantity per drive time of the developing device is calculated, the toner charge quantity in a developer is predicted on the basis of the calculated data, and a transfer bias voltage applied to a transfer device is also changed to thereby revise an image density.

4. The image forming apparatus according to claim 3, wherein when the developing bias voltage is changed, and an applied voltage of a charge device for charging the surface of a photosensitive body is also changed.

5. In an image forming apparatus employing a two-component developing system using a developer comprising a carrier and a toner, an method for revising an image density comprising: extracting integrated drive time of a developing device and integrated drive time of a toner replenishing motor every fixed printed-sheet number, calculating the toner consuming quantity per drive time of the developing device from the extracted data, predicting the toner charge quantity in a developer on the basis of the calculated data; and changing a developing bias voltage applied to the developing device to thereby revise an image density.

6. The image density correcting method according to claim 5, wherein when the developing bias voltage is changed, and an applied voltage of a charge device for charging the surface of a photosensitive body is also changed.

7. The image density correcting method according to claim 5, wherein the toner consuming quantity per drive time of the developing device is calculated, the toner charge quantity in a developer is predicted on the basis of the calculated data, and the transfer bias voltage applied to the transfer device is changed to thereby revise an image density.

8. The image density correcting method according to claim 7, wherein when the developing bias voltage is changed, and an applied voltage of a charge device for charging the surface of a photosensitive body is also changed.

* * * * *